United States Patent [19]

McLeod

[11] Patent Number: 5,020,590

[45] Date of Patent: Jun. 4, 1991

[54] BACK PRESSURE PLUG TOOL

[76] Inventor: Roderick D. McLeod, 5104-125 Street, Edmonton, Alberta, Canada, T6H 3V5

[21] Appl. No.: 443,475

[22] Filed: Nov. 30, 1989

[30] Foreign Application Priority Data

Dec. 1, 1988 [CA] Canada ..... 584718

[51] Int. Cl.[5] ..... E21B 19/00; E21B 33/068

[52] U.S. Cl. ..... 166/77; 166/80; 166/113; 166/316; 166/379; 166/386

[58] Field of Search ..... 166/77, 80, 113, 72, 166/73, 77.5, 85, 75.1, 316, 382, 386, 98, 379

[56] References Cited

U.S. PATENT DOCUMENTS

| | | | |
|---|---|---|---|
| 1,586,923 | 6/1926 | Townsend | 166/77 |
| 1,895,132 | 1/1933 | Minor | 166/77 |
| 4,241,786 | 12/1980 | Bullen | 166/77 |
| 4,460,039 | 7/1984 | Knight | 166/77 X |
| 4,632,183 | 12/1986 | McLeod | 166/77 |
| 4,875,523 | 10/1989 | Thornburrow | 166/77 |

*Primary Examiner*—Stephen J. Novosad

*Attorney, Agent, or Firm*—Stevens, Davis, Miller & Mosher

[57] ABSTRACT

In the area of oilfield wellhead equipment and well servicing, specifically the operations associated with the prevention of fluids and gases from escaping from the well when valves and associated equipment which normally control the flow of these fluids and gases have been removed for repair or for any other reason, the installation of and removal of a plug in the top of the tubing hanger is a common and necessary operation. This plug is commonly called a back-pressure plug and is a standard throughout the industry. A tool is proposed for installing and removing this plug while the well is under pressure, which tool will indicate that the plug is properly in place and will also overcome the operational problems associated with existing tools and the overall height associated with existing tools.

3 Claims, 7 Drawing Sheets

BACK PRESSURE PLUG TOOL

FIELD OF THE INVENTION

This invention relates to oil and gas well servicing and specifically to an apparatus for installing and removing the back-pressure plug or valve which is commonly used in gas and oil wells to hold the pressure in the well when the wellhead valves and equipment are being serviced, taken off or otherwise disabled.

BACKGROUND OF THE INVENTION

During the removal, servicing, replacement or repair of the valves and other equipment associated with an oil or gas well wellhead array, it is necessary to close off the passage through which the oil or gas comes out of the well and thus through this array. There are available several plugs and valves which can be installed in that part of the wellhead which is the final termination of the well with the wellhead array. The installation of this plug or valve, which shall hereinafter be called the back-pressure plug or be shortened to BPP, is generally done with the well under pressure, and with wellhead equipment such as the master valve, spools and blowout preventer on the well. The tools generally in use to install and remove this back-pressure plug will be referred to as back-pressure plug tools, or BPPTs.

The back-pressure plug tools generally in use are adequate to install and extract the back-pressure plug, however, they rely on the "feel" of the operator to tell if the plug is engaging the threads during installation and has turned in all the way. Also, due to their construction, high pressures encountered in many wells cause the back-pressure plug tool packing systems to tighten up and make them difficult to operate. The back-pressure plug tool of the present invention has a visual indicator which will show that the back-pressure plug is seated in the threads and has turned in all the way and will also give the operator the "feel" of the plug seating and breaking out regardless of pressure on the well. Movement in and out of the well is by hydraulic means for ease of operation.

SUMMARY OF THE INVENTION

According to a broad aspect, the invention relates to a tool consisting of a plug installation and removal pin loosely fixed in a splined sliding sleeve, which sleeve slides and is restrained on a splined wrenching shaft by pins running in slots in the sleeve. The splined wrenching shaft is hollow and terminates at its other end in a threaded portion and above that in a square or hexagonal way, this hex being suitable for turning with a wrench or the like. To the interior of the splined sliding sleeve is also attached, in a loosely confining arrangement, a thin rod which travels through an appropriate packing gland in the splined wrenching shaft, mates in a fixed concentric arrangement with a heavier rod which extends out of this wrenching shaft past the wrenching flats. It will be noted that this "signal rod" shows the position of the splined sliding sleeve and thus the back-pressure plug installation and removal pin affixed to it with respect to the top of the back-pressure plug tool. The splined sliding sleeve is also acted on by a concentric coil compression spring which is held in place on the splined wrenching shaft by a washer and circlip. This spring overcomes the effect of well pressure on the area presented by the thin rod in the packing gland. This complete assembly is placed inside the mandrel of the insertion drive part of the tool, a thrust bearing being placed between a shoulder on the splined wrenching shaft and an adapter on the mandrel. The insertion drive part of the tool also features a packing gland through which the hex end of the splined wrenching shaft extends, this wrenching shaft being held in place by locknuts on the threaded portion below the hex, the locknuts shouldering on the glandnut. The insertion drive part of the tool has two hydraulic cylinders mounted in such a way as to push the mandrel and its attached assembly and back-pressure plug into a wellhead array and thus into the position where the back-pressure plug is to be seated. The twin cylinder insertion drive is selected as the preferred method for running the back-pressure plug into the wellhead array. However it is shown by way of example only as it is obvious that screwjacks could be substituted for the two cylinders, or a single cylinder, concentric cylinder or even a concentric telescoping cylinder could be devised to do the insertion operation.

In operation, a back-pressure plug is threaded onto the plug installation and removal pin with a known torque or tightness, the complete back-pressure plug tool is mounted on a wellhead, the appropriate valves opened and the back-pressure plug moved through the wellhead array and into its position by action of the hydraulic cylinders. The reaching of this position in the tubing hanger is noted by the movement of the signal rod. The wrenching shaft is now rotated in a direction to turn the back-pressure plug into its seated position and then the back-pressure plug tool is detached from the back-pressure plug and removed, leaving the well sealed. The removal of the back-pressure plug is done in a reverse order, with the back-pressure plug tool moving the mandrel and assembly into the wellhead, movement of the signal rod noting when the back-pressure plug is reached, and the wrenching shaft being rotated in such a way as to thread into, unseat and pickup the back-pressure plug. The back-pressure plug is removed from the wellhead array and the appropriate valves closed and the back-pressure plug tool taken off the wellhead.

BRIEF DESCRIPTION OF THE DRAWINGS

The invention is illustrated by way of example only in the accompanying drawings in which.

DESCRIPTION OF THE EXISTING EMBODIMENT

Figure 10:
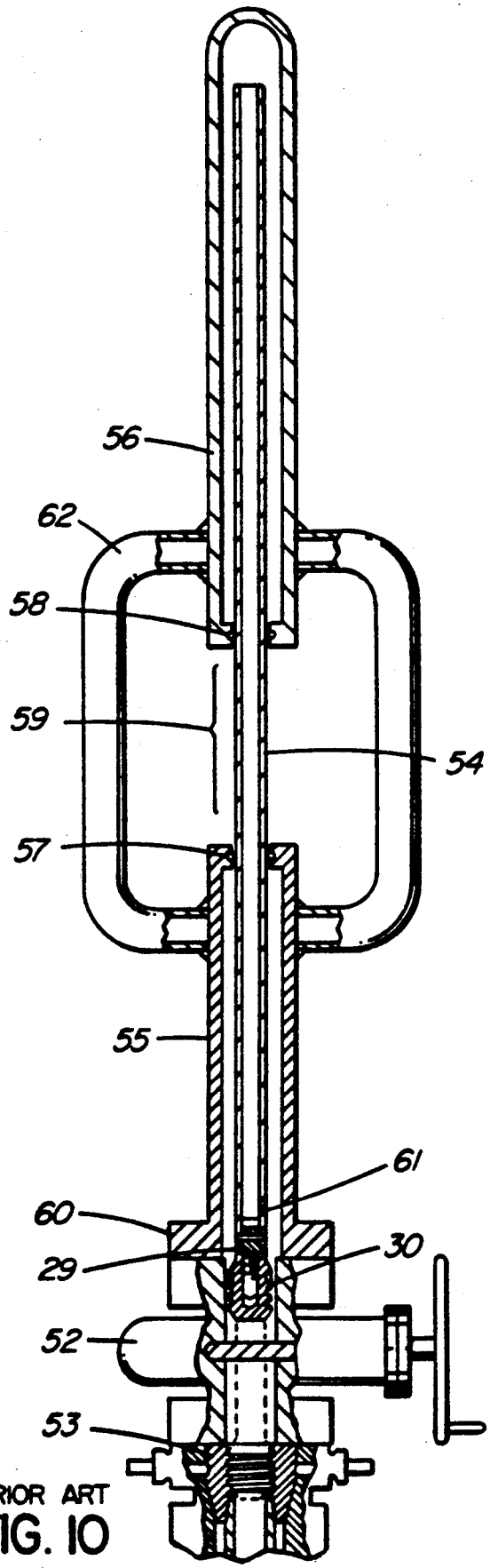
PRIOR ART FIG. 10
FIG. 10 is a cross sectional view of one of the existing tools on a simple wellhead.

Referring to FIG. 10, one of the existing tools designed by Cameron many years ago consists of a central rod 54 termed the polish rod, this being terminated at its lower end by a plug installation and removal pin 29 pinned in place. This hollow polish rod extends upwards through the lower tube 55, the packing glands 57 and 58 and terminates inside the upper tube 56. This upper tube is sealed at the top end and attached in a dual and rigid way to the lower tube by the braces 62 and thus to the lower tube wellhead adapter 60. The section 59 of the polish rod is open to action by the operator from the outside of the tool. The port 61 allows well pressure communication to the cavity in the upper tube. In operation the back-pressure plug 30 is threaded onto the plug installation and removal pin 29 with a known torque and the tool is mounted on the wellhead valve 52 as shown and this valve is opened. The polish shaft is pushed downward by hand, the operator acting on the open portion of the polish rod at 59. It will be noted that the well pressure acting on the polish rod does so in a counterbalanced way so the operator has only to overcome the resistance of the polish rod moving through the packing glands. This is considerable when a high pressure well is being worked on. When the operator "feels" the back-pressure plug 30 land on the top of the tubing hanger threads, he will turn the polish rod in the appropriate direction with the aid of a wrench and begin to seat the back-pressure plug 30 in the tubing hanger. When the back-pressure plug 30 is seated, noted by the dotted lines, continued rotation will break loose the thread between the back-pressure plug 30 and plug installation and removal pin 29. When this is fully disengaged, the polish rod is pulled up by the operator and the well is considered sealed. The action to take the back-pressure plug 30 out is the opposite of the installation procedure. The operator moves the polish rod and the attached plug installation and removal pin 29 through the wellhead and "feels" the engagement of the plug installation and removal pin 29 male thread with the back-pressure plug female thread and then rotates the polish rod in such a direction as to threadingly connect the back-pressure plug 30 and plug installation and removal pin 29. After the connection is made, the continued rotation will disengage the back-pressure plug 30 from its opposite handed threads in the tubing hanger 53. When the back-pressure plug 3 "feels" free of the tubing hanger 53, the polish rod and thus the now attached back-pressure plug 30 is pulled out of the well by the operator and the master valve is closed. The tool is then taken off of the wellhead valve. The disadvantages of this system are:

a. the difficulty of relying on the "feel" of what is happening in the enclosed well space;
b. the force required to vertically move the polish rod when well pressure is acting on the two packing glands;
c. the force required to rotate the polish rod when well pressure is acting on the two packing glands;
d. scratching and grooving of the polish rod in the open area by the wrench used for moving it and subsequent damage to the packing glands.

DESCRIPTION OF THE PREFERRED EMBODIMENT

Figure 1:
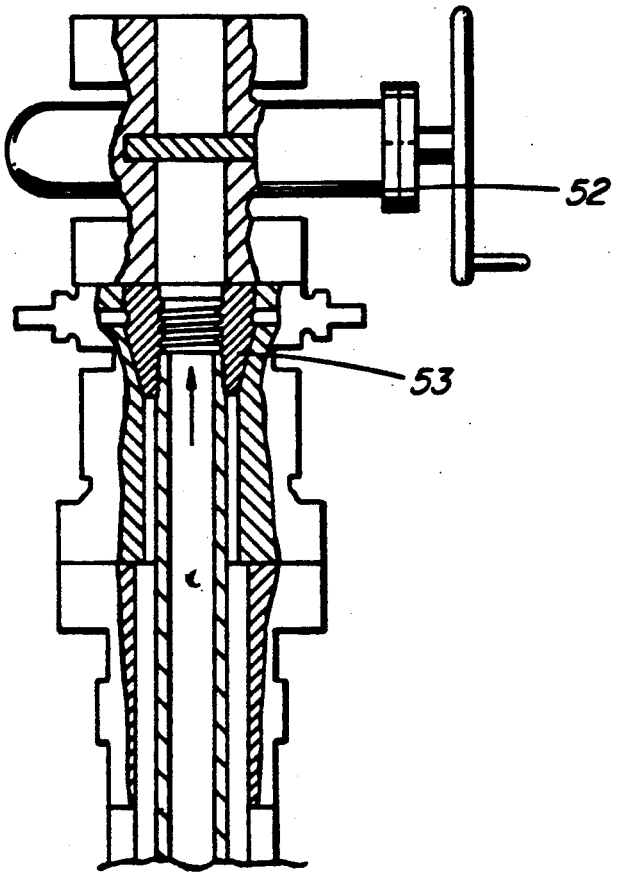
FIG. 1 is a cross sectional schematic view of a simple wellhead array showing the master valve as the fitting to be taken off.
Figure 2:
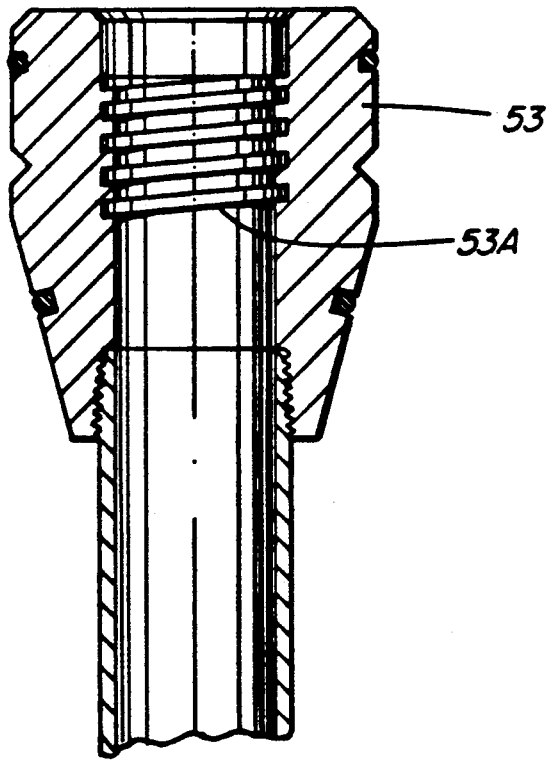
FIG. 2 is an expanded sectional view of the tubing hanger from FIG. 1, illustrating the left hand female thread in the hanger bore.
Figure 3:
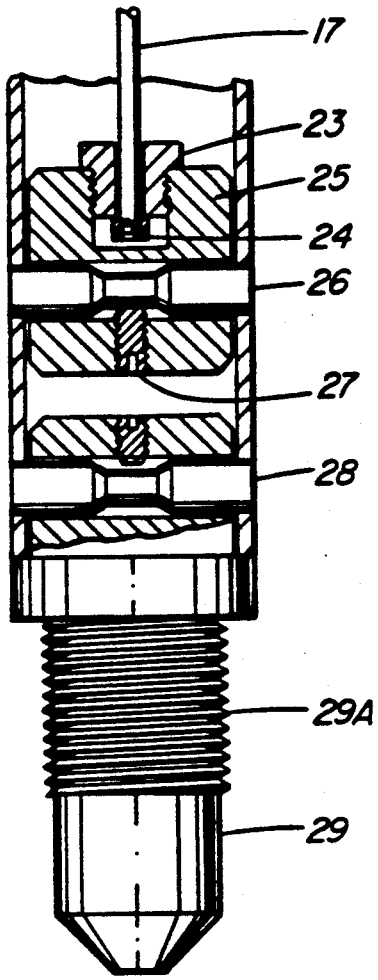
FIG. 3 is a cross sectional view of a standard back-pressure plug installation and removal pin illustrating the right hand male thread, the pins connection to the splined sliding sleeve and the signal rod connection to the splined sliding sleeve.
Figure 4:
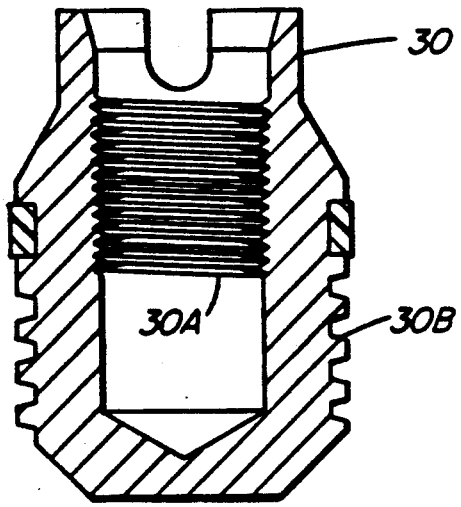
FIG. 4 is a cross sectional view of a typical Back-pressure Plug, illustrating the internal female right hand thread, compatible with the right hand male thread of the pin in FIG. 3, the sealing gasket, and the external left hand male thread compatible with the left hand female thread in FIG. 2; there exist several models of the plug, with different internal structures.
Figure 5:
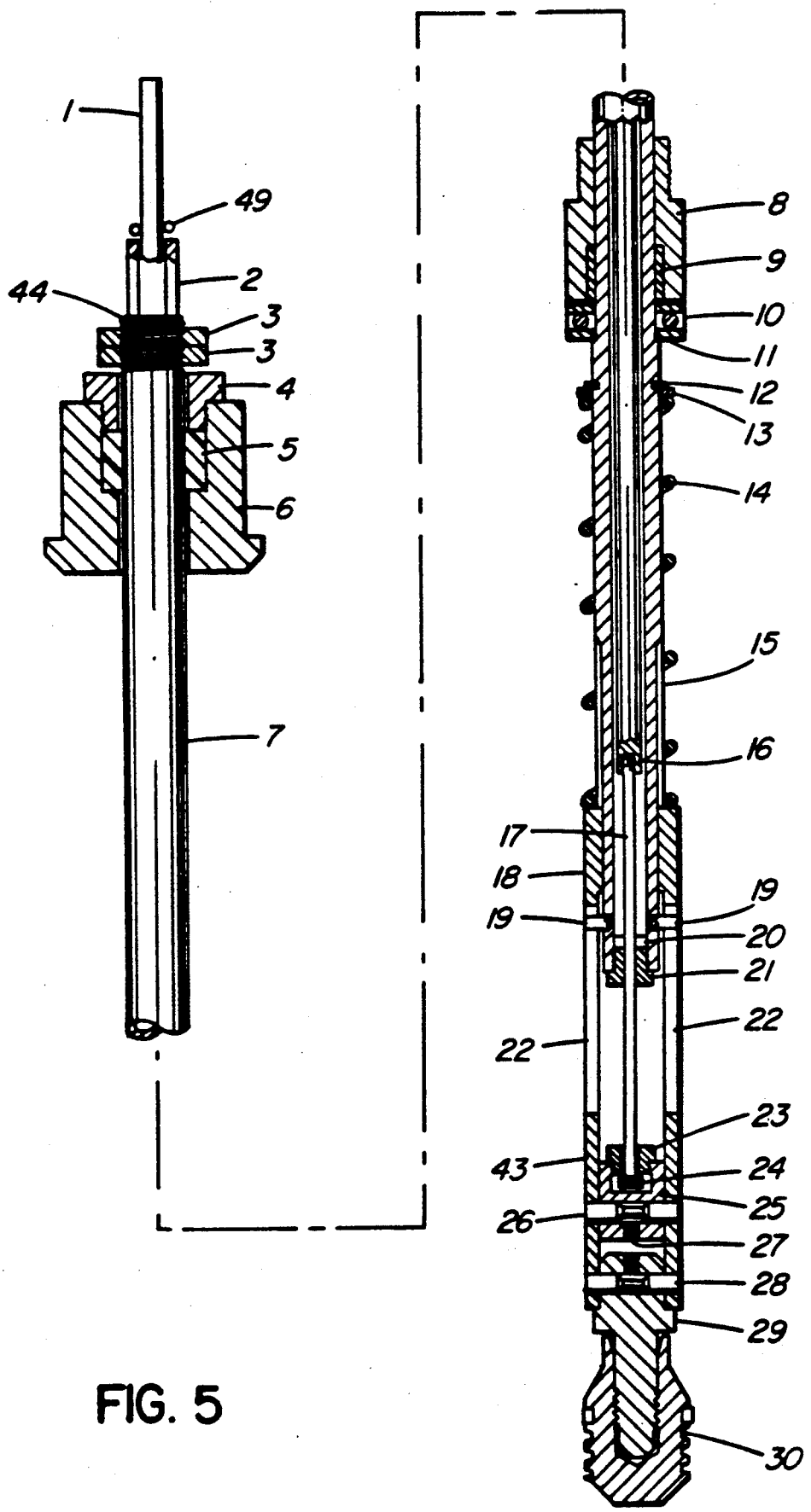
FIG. 5 is a view mainly in cross section of the interior and working parts of the back-pressure plug tool in the extended position with the back-pressure plug attached.

Referring to FIG. 5, the tool illustrated generally includes a signal shaft 1 with its tight fitting "O" ring 49, which shaft extends concentrically through the wrenching hex portion 2 and the threaded portion 44 of the wrenching shaft 7, and this signal shaft has as part of its lower extremity a connection at 16 to a reduced diameter section 17 which fits slidingly through the packing 20 of the gland 21 in the lower extremity of the wrenching shaft and is then held in a loosely confining way to the plug 25 by the gland 23 and the threadingly attached locknuts 24. The plug 25 is held concentrically inside the splined sliding sleeve 43 by the pin 26 which is restrained by the setscrew 27. Also held adjacent in the splined sliding sleeve by the restrained pin 28 is the plug installation and removal pin 29, shown in detail in FIG. 3, and held to it by a right hand thread is the back-pressure plug 30, shown in detail in FIG. 4. The splined sliding sleeve 43 has internal splines at 18 and slides in a vertical direction on the splines 15 of the wrenching shaft 7, this sleeve being limited in movement by the restraining action of the setpins 19 which act in the slots 22 of the splined sliding sleeve 43. The wrenching shaft 7 has a shoulder at 11, circlip at 12 and a washer at 13, this washer restraining the concentric spiral compression spring 14 which terminates at its lower end on the shoulder of the splined sliding sleeve 43. The mandrel adapter 8, its bushing 9 and the thrust bearing 10 located on the wrenching shaft at the shoulder 11 and the gland 6, its packing 5, and glandnut 4 are mounted to the wrenching shaft in a concentric rotating way. The locknuts 3 act on the shoulder of the glandnut 4 in a restraining way.

Figure 6:
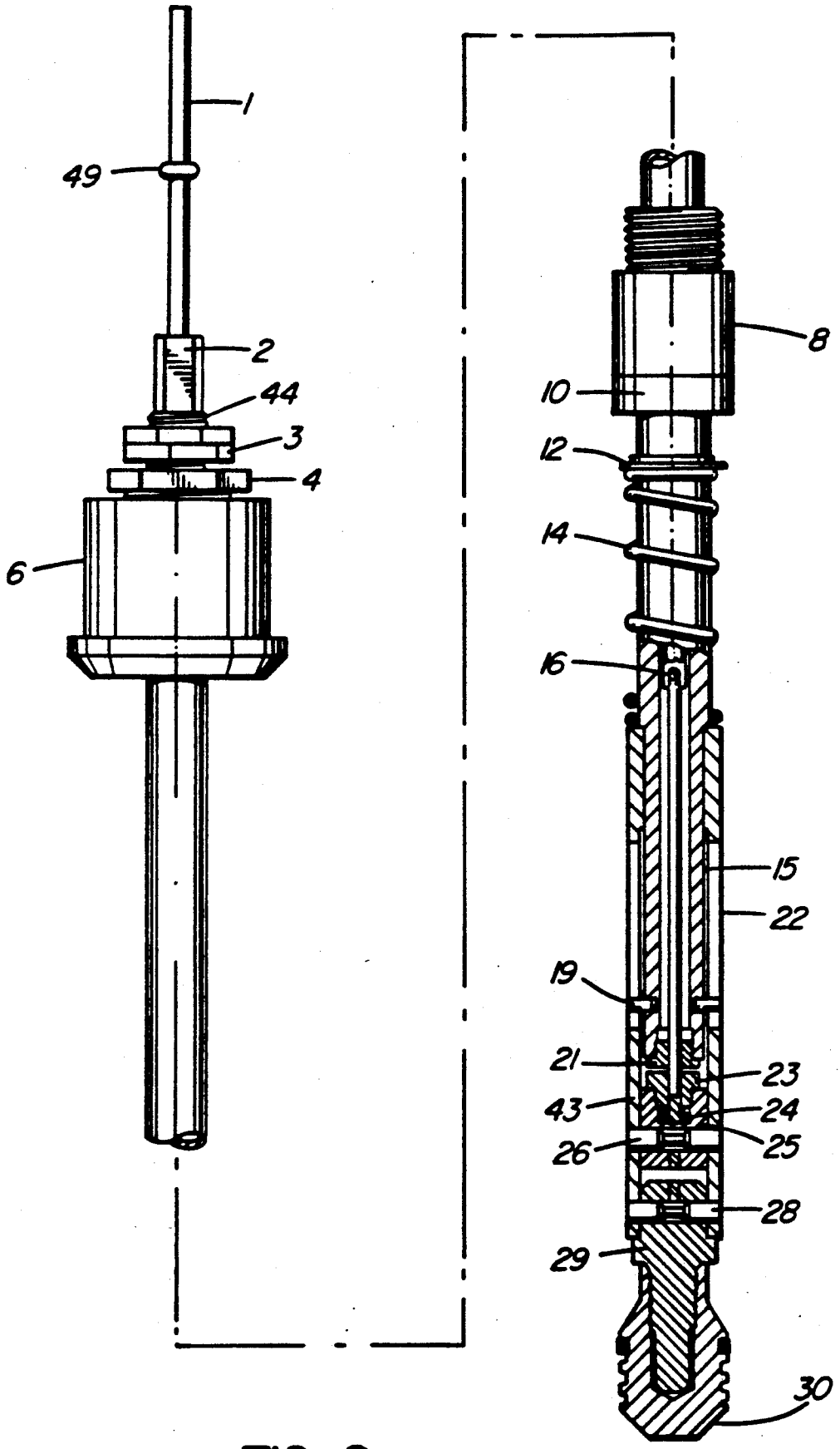
FIG. 6 is a view partially in cross section of FIG. 5 of the internal working parts of the back-pressure plug tool in the compressed position with the back-pressure plug attached.

FIG. 6 illustrates the action of the internal assembly. Note that the distance between the packing gland 6 and the mandrel adapter 8 will be set by the length of the mandrel and thus will remain constant. A force upward on the back-pressure plug 30 will cause the sliding splined sleeve 43 to move upwards on the splines 15 of wrenching shaft 7 against the force of the spiral compression spring 14. This movement will also be translated to the signal rod 1 which will move upward with respect to the hex top 2 of the wrenching shaft 7. The tight fitting concentric "O" ring 49 will allow a movement to be observed and measured.

Figure 7:
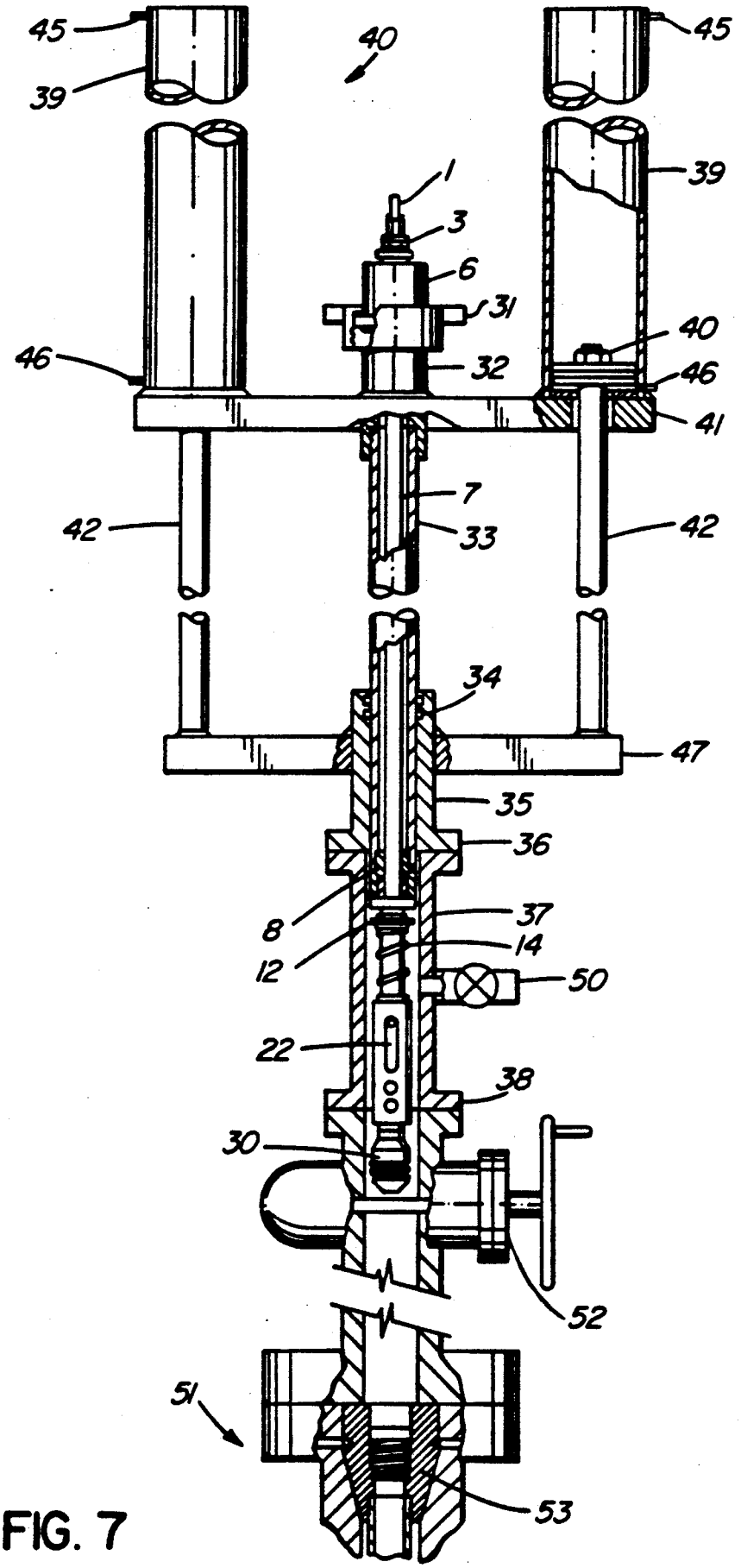
FIG. 7 is a view mainly in cross section of the complete back-pressure plug tool with assembly from FIG. 6 installed in the insertion drive, and the whole back-pressure plug tool mounted on the simple wellhead array from FIG. 1, prior to opening the master valve and running the back-pressure plug into the wellhead array.
Figure 8:
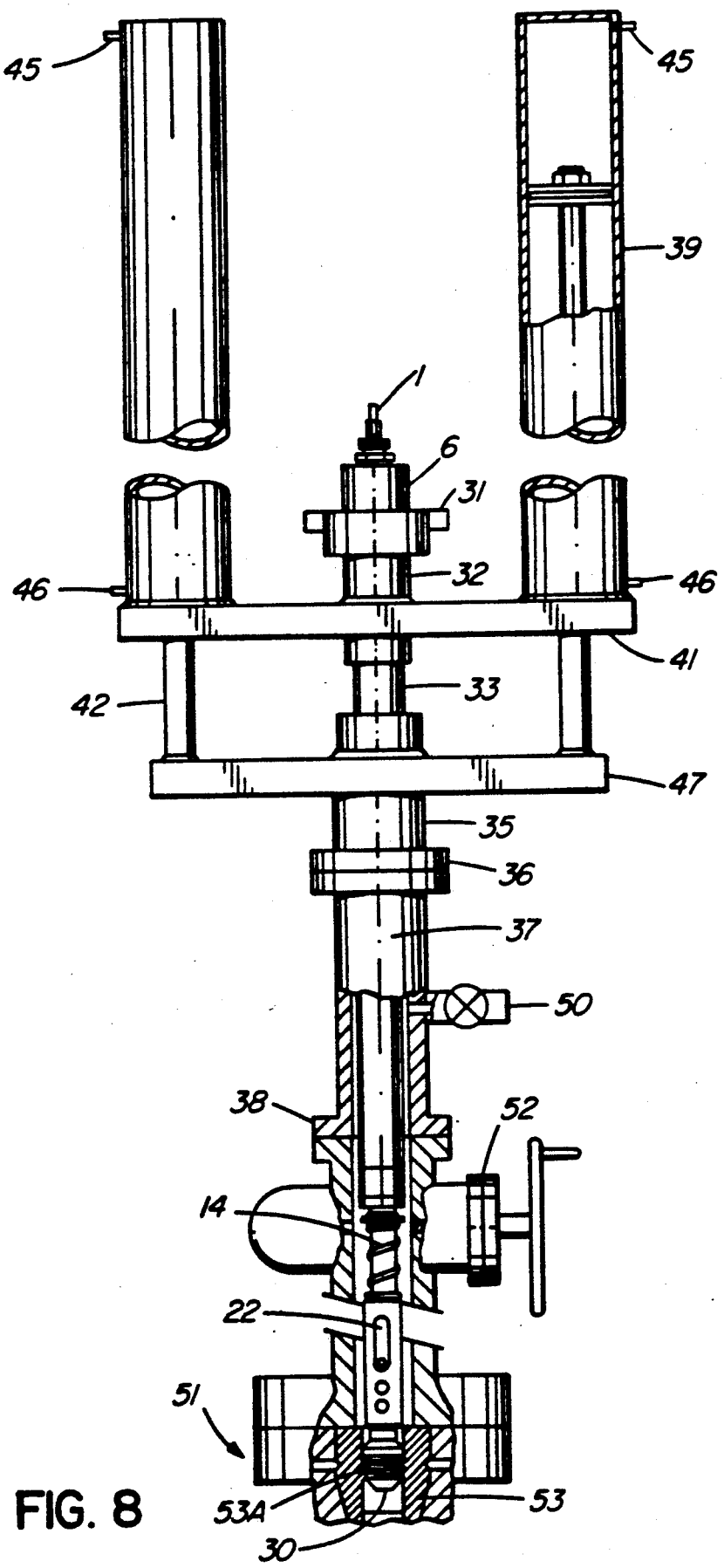
FIG. 8 is a view partially in cross section of the back-pressure plug landed in the tubing hanger by the action of the back-pressure plug tool and having been rotated into the threads.

FIG. 7 illustrates the extended assembly from FIG. 5 installed in the insertion drive shown generally at 48 and the whole back-pressure plug tool mounted on the wellhead shown generally at 51. The insertion drive features the two hydraulic cylinders 39, attached to the upper beam 41, their fluid inlets 45 and 46, their pistons 40 and the piston rods 42 which are attached to the lower beam 47. Concentric in the upper beam is the upper body 32 which holds in the packing gland 6 with the locking ring 31. Threadingly attached to this upper body is the hollow mandrel 33 which extends downward through the lower body 35, its packing 34 and the mounting flange 36, this lower body being concentrically mounted in the lower beam 47. The lower body mounts to the flowtee 37 and its valve 50. They are mounted to the wellhead valve 52 at the adapter flange 38. Below this valve is the tubing hanger at 53. In practice it would be noted that the back-pressure plug 30 has first been threaded onto the plug installation and removal pin 29 and tightened with a known amount of torque. The wellhead valve 52 is opened and fluid pressure applied to the ports 46 of the hydraulic cylinders 39. This causes the pistons and rods to move in an upward direction, thus moving the upper beam 41, the mandrel and its assembly down through the wellhead and into the position shown in FIG. 8. When the back-pressure plug 30 reaches the tubing hanger threads 53A and butts up to them, the signal rod will move upwards as explained in FIG. 6. When it rises a known distance, the wrenching shaft 7 is turned in a left handed way by a wrenching means, thus turning the back-pressure plug 30 into the matching left hand threads 53A in the tubing hanger 53. The sliding splined sleeve 43, while transmitting the turning torque from the wrenching shaft 7 to the back-pressure plug 30, will also slide downwards on the splines 15 of the wrenching shaft 7 as the back-pressure plug 30 threads into the hanger thus moving the signal rod 1 in a downwards direction. When the back-pressure plug 30 bottoms out in the threaded hole, transmitting a feeling of greater resistance to the wrenching means, the distance moved by the signal shaft 1 in the downward direction and also the counting of the turns of the wrenching shaft 7 will both confirm the back-pressure plug 30 has been properly set. At this point, continued rotation of the wrenching shaft 7 in a left hand way with a torque greater than that with which the back-pressure plug 30 was tightened on to the plug installation and removal tool 29 will cause the right hand thread on the plug installation and removal tool 29 to come loose from the thread in the back-pressure plug 30. As this comes unthreaded, the signal rod 1 will move in an upward direction until the plug installation and removal pin 29 and back-pressure plug 30 are disengaged. This distance will again be noted at the signal rod 1. When the disengagement is complete, fluid pressure will be applied to hydraulic cylinder ports 45, and the mandrel and assembly will move out of the wellhead array. To test the sealing integrity of the back-pressure plug 30, the valve at 50 will be opened. If no leakage is detected, the well is considered sealed and the back-pressure plug tool and the wellhead valve and any equipment above the back-pressure plug 30 may be removed.

Figure 9:
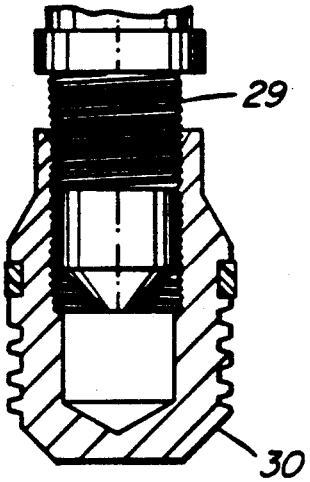
FIG. 9 is a cross sectional view of the back-pressure plug and the plug installation and removal pin illustrating the effect of the right hand rotation of the pin in the back-pressure plug.

When it is required to take the back-pressure plug 30 out of the tubing hanger 53 and wellhead array, the back-pressure plug tool is set up on the wellhead valve 52 again as in FIG. 7, but with no back-pressure plug in place on the plug installation and removal pin. The wellhead valve 52 is opened and fluid pumped to the ports 46 of the hydraulic cylinders. The mandrel and its assembly moves into the wellhead. When the plug installation and removal pin 29 reaches the back-pressure plug 30, it will be noted that the signal rod 1 will rise. The wrenching shaft 7 is now turned in a right handed direction and the plug installation and removal pin 29 will thread into the back-pressure plug 30 as shown in FIG. 9. The signal rod 1 will move down. The number of turns to turn the plug installation and removal pin 29 into the back-pressure plug 30 may be counted, however this measurement will be noted by watching the signal rod. When the plug installation and removal pin 29 bottoms out in the back-pressure plug 30, continued rotation of the wrenching shaft 7 will turn the left hand thread 30B on the exterior of the back-pressure plug 30 out of the mating thread 53A in the tubing hanger 53. The signal rod 1 will move up during this action. When the back-pressure plug 30 has been disengaged from the tubing hanger 53, the action of the hydraulic cylinders 39 is reversed and the back-pressure plug 30 withdrawn from the wellhead array. The wellhead valve 52 is now closed and the back-pressure plug tool is taken off.

Those skilled in the art will appreciate that various features, characteristics and advantages of the present invention have been set forth herein or are readily realizable from the detailed description of the preferred embodiment. However, the disclosure is illustrative and various changes may be made while utilizing the principles of the present invention and falling within the scope of the invention as expressed in the appended claims.

I claim:

1. A back pressure plug tool assembly for mounting on a wellhead valve, said assembly comprising:

(a) spaced, parallel upper and lower beam members oriented transverse to the longitudinal axis of said wellhead valve and wellhead casing on which said wellhead valve is mounted;

(b) hydraulic ram means interconnecting said upper and lower beam members and for moving said beam members toward and away from one another;

(c) upper and lower mandrel support bodies mounted in axial alignment with one another in said upper and lower beam members, respectively, said lower support body being adapted for mounting on said wellhead valve;

(d) a mandrel assembly mounted in and extending between said upper and lower support bodies, said mandrel assembly including (i) an elongated splined slidable sleeve; (ii) a plug installation and removal pin detachably connected to the lower end of said slidable sleeve, (iii) a cylindrical wrenching shaft having a splined lower end concentrically located and telescopically slidable in the upper end of said splined slidable sleeve;

(e) a compression spring positioned on the exterior of said wrenching shaft, spring retaining means on the wrenching shaft and on the upper end of said slidable sleeve whereby said spring biases said wrenching shaft outwardly of said sleeve;

(f) thrust bearing means slidably receiving said wrenching shaft in said lower mandrel support body;

(g) packing gland means in the upper mandrel support body and slidably receiving the upper end of said wrenching shaft;

(h) means adjacent the upper end of said wrenching shaft for rotating the same; and (i) a signal rod centrally and concentrically located in said mandrel assembly and having its lower end connected to said slidable sleeve and its upper end extending outwardly and upwardly of the upper end of said wrenching shaft.

2. Apparatus according to claim 1 wherein said hydraulic ram means interconnecting said upper and lower beam members, when actuated in a first direction, draws the upper beam toward the lower beam to insert the lower end of said mandrel assembly into said wellhead casing and to position a back pressure plug on the lower end of said plug insertion and removal pin into said tubing hanger; means in said mandrel assembly to rotate said back pressure plug responsive to rotation of the upper end of said wrenching shaft thereby to seat said back pressure plug in said tubing hanger; signal means in said assembly to monitor progress of rotation of said wrenching shaft and to indicate when said back pressure tool is fully installed in said tubing hanger; means to monitor the position of said plug insertion and removal pin when it is disengaged by a continued rotation of said wrenching shaft; and said hydraulic ram means, when actuated in a second direction, effecting upward movement of said mandrel assembly after said back pressure plug has been installed.

3. Apparatus according to claim 2 wherein said hydraulic ram means, when actuated in said first direction, moves said plug insertion and removal tool into an engaging position with said back pressure plug; said monitor means indicates progress of engagement between said plug installation and removal tool with said back pressure plug in response to rotation of said wrenching shaft; and wherein said hydraulic means, when subsequently operated in said second direction, raises the engaged back pressure plug out of said wellhead.

* * * * *